US010637172B2

(12) United States Patent
Liu et al.

(10) Patent No.: US 10,637,172 B2
(45) Date of Patent: Apr. 28, 2020

(54) COAXIAL MALE CONNECTOR, COAXIAL FEMALE CONNECTOR AND ASSEMBLY THEREOF

(71) Applicant: CommScope Technologies LLC, Hickory, NC (US)

(72) Inventors: Jin Liu, Suzhou (CN); Yujun Zhang, Suzhou (CN); Yuanyao Zhou, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/149,751

(22) Filed: Oct. 2, 2018

(65) Prior Publication Data

US 2019/0131735 A1 May 2, 2019

(30) Foreign Application Priority Data

Oct. 27, 2017 (CN) ..... 2017 1 1024632

(51) Int. Cl.
*H01R 9/05* (2006.01)
*H01R 13/05* (2006.01)
(Continued)

(52) U.S. Cl.
CPC ..... *H01R 13/052* (2013.01); *H01R 13/111* (2013.01); *H01R 13/502* (2013.01);
(Continued)

(58) Field of Classification Search
CPC .. H01R 13/052; H01R 13/502; H01R 13/111; H01R 13/5219; H01R 13/623; H01R 24/38; H01R 2103/00; H01R 24/40
(Continued)

(56) References Cited

U.S. PATENT DOCUMENTS 6,609,925 B1 8/2003 Cannon
6,794,578 B2 * 9/2004 Bracaleone ..... H01R 13/746 174/117 FF
(Continued)

FOREIGN PATENT DOCUMENTS

CN 101552386 10/2009
KR 100646756 B1 11/2006

OTHER PUBLICATIONS

International Search Report and Written Opinion of the International Searching Authority, International Application No. PCT/US2018/056174, dated Mar. 12, 2019, 14 pp.
(Continued)

*Primary Examiner* — Abdullah A Riyami
*Assistant Examiner* — Nelson R. Burgos-Guntin
(74) *Attorney, Agent, or Firm* — Myers Bigel, P.A.

(57) ABSTRACT

An assembly includes a coaxial male connector and a coaxial female connector. The coaxial male connector includes: an inner contact; a monolithic outer body having a plurality of spring fingers and a shoulder that is located radially outward of the spring fingers; a dielectric spacer disposed between the inner contact and the outer body such that the outer body is coaxial with the inner contact; and a coupling nut that at least partially overlies the outer body. The coaxial connector includes: an inner contact having a plurality of spring fingers mated with the spring fingers of the inner contact of the male connector; an outer body having an inner surface and a contact surface at one end, the contact surface contacting the shoulder of the outer body of the male connector; and a dielectric spacer disposed between the inner contact and the outer body such that the outer body is coaxial with the inner contact, the spacer being configured so that a gap is present between an outer surface of the spacer and the inner surface of the outer body. The spring fingers of the outer body of the male connector contact the
(Continued)

inner surface of the outer body and apply radial pressure thereto.

20 Claims, 3 Drawing Sheets

(51) Int. Cl.

| | |
|---|---|
| ***H01R 13/502*** | (2006.01) |
| ***H01R 13/11*** | (2006.01) |
| ***H01R 24/40*** | (2011.01) |
| *H01R 13/52* | (2006.01) |
| *H01R 13/623* | (2006.01) |
| *H01R 24/38* | (2011.01) |
| *H01R 103/00* | (2006.01) |

(52) U.S. Cl.
CPC ..... *H01R 24/40* (2013.01); *H01R 13/5219* (2013.01); *H01R 13/623* (2013.01); *H01R 24/38* (2013.01); *H01R 2103/00* (2013.01)

(58) Field of Classification Search
USPC ..... 439/583, 578, 246, 320, 607.01, 607.04
See application file for complete search history.

(56) References Cited

U.S. PATENT DOCUMENTS 6,878,008 B2 * 4/2005 Brancaleone ..... H01R 13/5841 29/748
7,455,550 B1 * 11/2008 Sykes ..... H01R 13/506 439/578
7,500,873 B1 * 3/2009 Hart ..... H01R 4/023 439/350
8,827,743 B1 9/2014 Maury
10,243,310 B1 * 3/2019 Monahan ..... H01R 25/003
2012/0088407 A1 * 4/2012 Natoli ..... H01R 24/564 439/585
2012/0129375 A1 * 5/2012 Van Swearingen ..... H01R 9/05 439/314
2013/0029522 A1 * 1/2013 Holliday ..... H01R 24/40 439/584
2013/0137300 A1 5/2013 Eriksen et al.
2014/0134876 A1 * 5/2014 Vaccaro ..... H01Q 21/00 439/578
2016/0322751 A1 * 11/2016 Van Swearingen ..... H01R 13/642
2017/0110839 A1 4/2017 Vaccaro
2017/0324197 A1 * 11/2017 Grassl ..... H01R 13/193
2018/0006398 A1 * 1/2018 Cuban ..... H01R 24/42
2018/0006420 A1 * 1/2018 Urtz, Jr. ..... H01R 13/622
2018/0054017 A1 * 2/2018 Watkins ..... H01R 9/0521
2018/0123288 A1 * 5/2018 Shao ..... H01R 13/6277
2019/0131735 A1 * 5/2019 Liu ..... H01R 13/052
2019/0252836 A1 * 8/2019 Watkins ..... H01R 13/622

OTHER PUBLICATIONS

Office Action corresponding to Chinese Application No. 201711024632.1 dated Dec. 3, 2019.

* cited by examiner

COAXIAL MALE CONNECTOR, COAXIAL FEMALE CONNECTOR AND ASSEMBLY THEREOF

RELATED APPLICATION

The present application claims priority from and the benefit of Chinese Patent Application No. 201711024632.1, filed Oct. 27, 2017, the disclosure of which is hereby incorporated herein in its entirety.

FIELD OF THE INVENTION

The present invention is directed generally to electrical cable connectors, and more particularly to coaxial connectors for electrical cable. More specifically, the present invention is directed to a coaxial male connector, a coaxial female connector and an assembly including them.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include an inner contact, such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

A new proposed 4.3/10 interface under consideration by the IEC (46F/243/NP) (hereinafter the 4.3/10 interface) is alleged to exhibit superior electrical performance and improved (easier) mating. The 4.3/10 interface includes the following features: (a) separate electrical and mechanical reference planes; and (b) radial (electrical) contact of the outer conductor, so that axial compression is not needed for high normal forces. The alleged benefits of this arrangement include:

- Increased mechanical stability, as the mechanical reference plane is now outside the RF path;
- Non-bottoming of the electrical reference plane (as contact is made in the radial direction)—therefore, normal (radial) forces are independent from coupling nut torque applied;
- Coupling nut torque reduction;
- Improvement in PIM performance as outer contact radial forces are independent of coupling nut torque applied; and
- Gang mating of several connectors as the electrical reference plane can float (axially). Therefore, tolerance stack-ups from connector to connector should have no effect.

It may be desirable to provide additional versions of connectors that meet the 4.3/10 interface standard and also address other performance issues like PIM reduction.

SUMMARY

As a first aspect, embodiments of the invention are directed to a coaxial male connector, comprising: an inner contact configured to mate with spring fingers of an inner contact of a mating coaxial female connector; a monolithic outer body having a plurality of spring fingers configured to mate with an outer body of the mating female connector, the outer body including a shoulder that is located radially outward of the spring fingers that is configured to provide a contact surface for the outer body of the mating female connector; a dielectric spacer disposed between the inner contact and the outer body such that the outer body is coaxial with the inner contact; and a coupling nut that at least partially overlies the outer conductor body.

As a second aspect, embodiments of the invention are directed to a coaxial female connector, comprising: an inner contact having a plurality of spring fingers configured to mate with spring fingers of an inner contact of a coaxial male connector; an outer body having an inner surface and a contact surface at one end, the contact surface being configured to contact a shoulder of an outer body of a mating coaxial male connector; and a dielectric spacer disposed between the inner contact and the outer body such that the outer body is coaxial with the inner contact, the spacer begin configured so that a gap is present between an outer surface of the spacer and the inner surface of the outer body, the gap being configured to receive spring fingers of the outer body of the mating male connector.

As a third aspect, embodiments of the invention are directed to an assembly comprising a coaxial male connector and a coaxial female connector. The coaxial male connector comprises: an inner contact; an outer body having a plurality of spring fingers and a shoulder that is located radially outward of the spring fingers; a dielectric spacer disposed between the inner contact and the outer body such that the outer conductor body is coaxial with the inner contact; and a coupling nut that at least partially overlies the outer conductor body. The female coaxial connector comprises: an inner contact having a plurality of spring fingers mated with the spring fingers of the inner contact of the male connector; an outer body having an inner surface and a contact surface at one end, the contact surface contacting the shoulder of the outer body of the male connector; and a dielectric spacer disposed between the inner contact and the outer body such that the outer conductor body is coaxial with the inner contact, the spacer being configured so that a gap is present between an outer surface of the spacer and the inner surface of the outer body. The spring fingers of the outer body of the male connector contact the inner surface of the outer body and apply radial pressure thereto.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
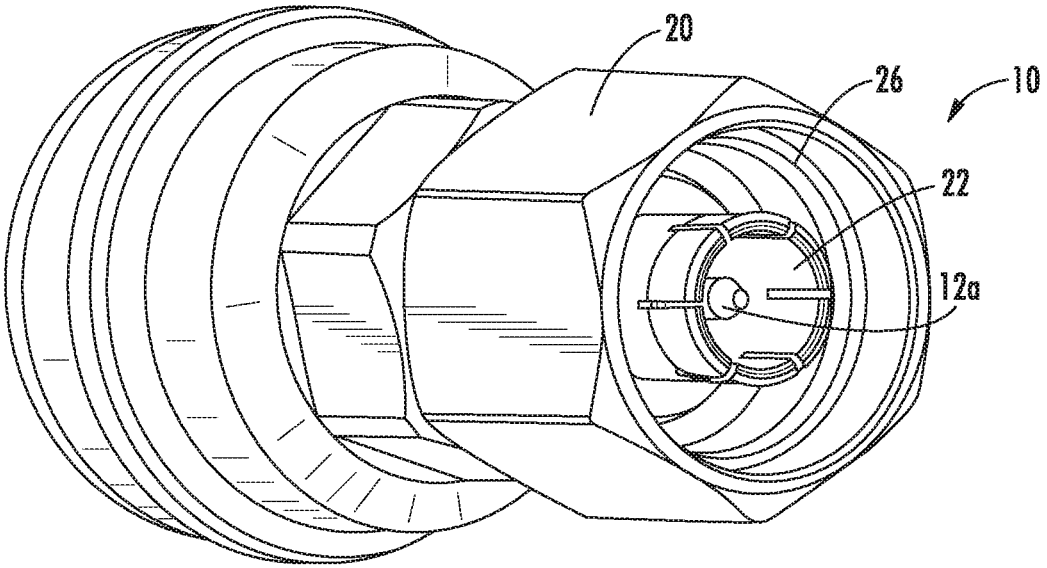
FIG. 1 is a perspective view of a male connector according to embodiments of the invention.
Figure 2:
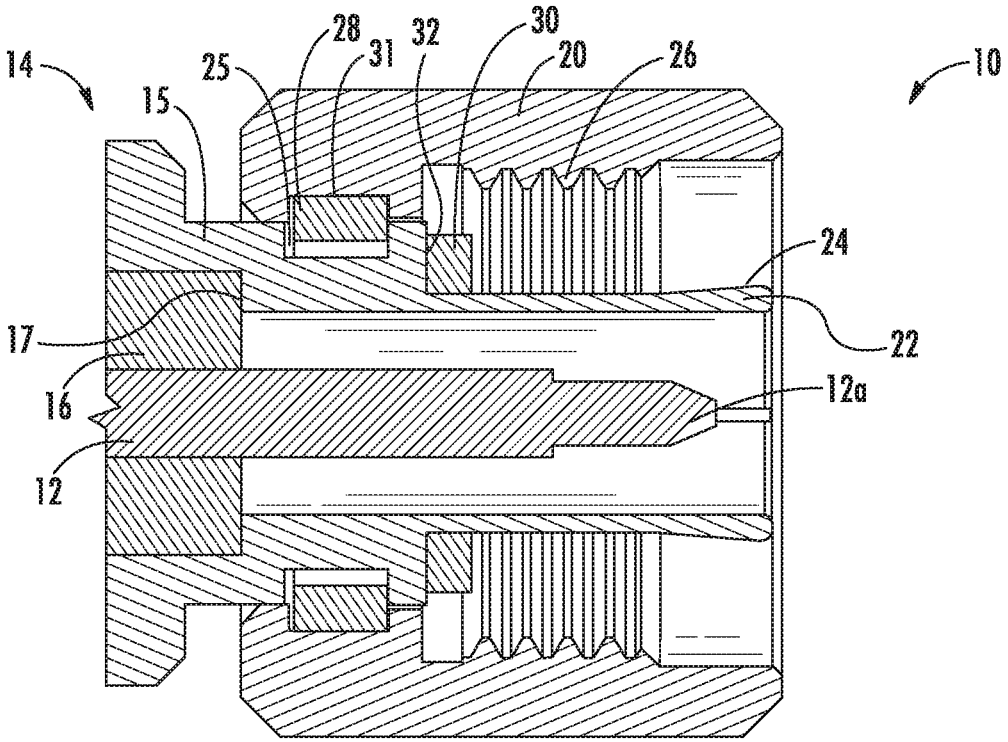
FIG. 2 is a section view of the male connector of FIG. 1.

Referring now to the drawings, a male connector, designated broadly at 10, is shown in FIGS. 1 and 2. The male connector 10 includes an inner contact 12 with a beveled tip 12*a*, a (typically monolithic) outer body 14, a dielectric spacer 16, and a coupling nut 20. As can be seen in FIG. 2, the spacer 16 encircles one end of the inner contact 12. Although a coaxial cable is not shown herein, those skilled in this art will appreciate that the inner contact 12 is electrically coupled (either galvanically or capacitively) to the inner conductor of the cable, and the outer body 14 is similarly electrically coupled to the outer conductor of the cable. As used herein, a component of a connector is "forward" of another component if it is farther from the cable, and "rearward" of another component if it is nearer the cable.

A main sleeve 15 of the outer body 14 encircles the spacer 16, which abuts a shoulder 17 of the outer body 14. A recess 25 is present in the outer surface of the main sleeve 15 forward of the shoulder 17. At the forward end of the outer body 14, a plurality of spring fingers 22 extend forwardly generally parallel to the inner contact 12. The spring fingers 22 are tapered slightly to widen toward their free ends, thereby creating a slightly angled outer surface 24.

A sealing gasket 30 abuts a shoulder 32 of the outer body 14 located rearwardly of the spring fingers 22. A snap ring 28 is located in the recess 25 and in a recess 31 in the inner surface of the coupling nut 20, and thereby retains the coupling nut 20 with the outer body 14. Threads 26 are also located on the inner surface of the coupling nut 20 forwardly of the recess 25.

Figure 3:
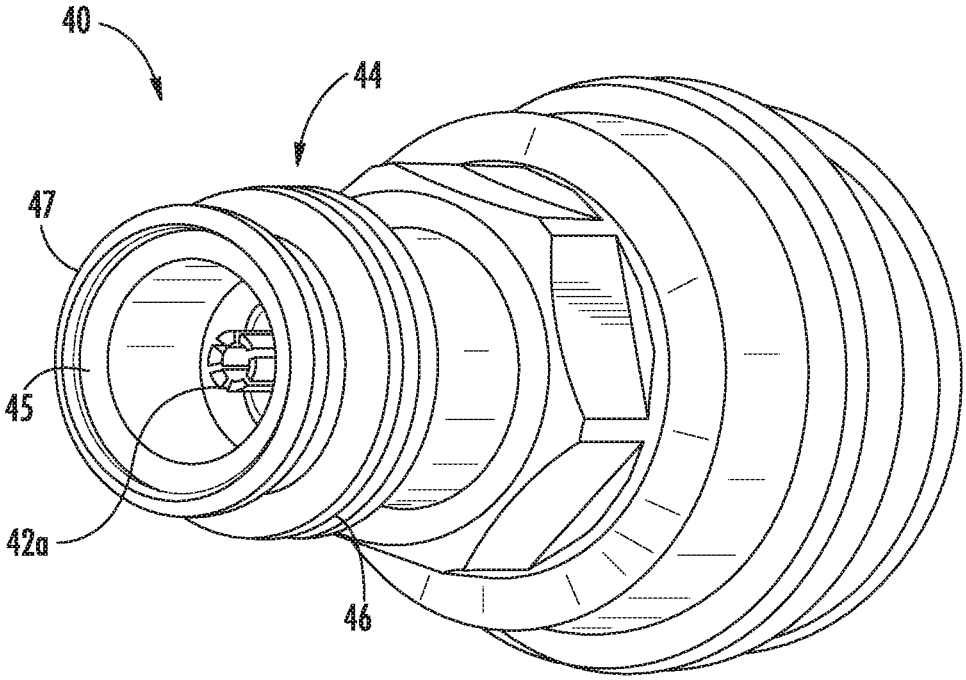
FIG. 3 is a perspective view of a female connector according to embodiments of the invention.
Figure 4:
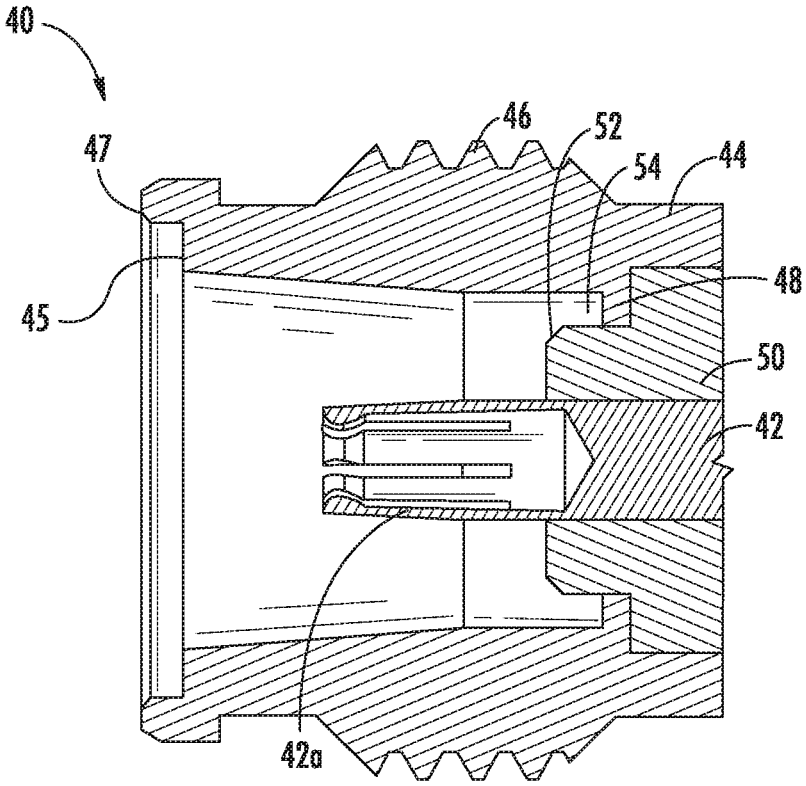
FIG. 4 is a section view of the female connector of FIG. 3.

Referring now to FIGS. 3 and 4, a mating female connector 40 is illustrated therein. The female connector 40 includes an inner contact 42 with spring fingers 42*a* at its forward end. A dielectric spacer 50 with a stepped forward end encircles the inner contact 42. An outer body 44 encircles the spacer 50. Although a coaxial cable is not shown herein, those skilled in this art will appreciate that the inner contact 42 is electrically coupled (either galvanically or capacitively) to the inner conductor of the cable, and the outer body 44 is similarly electrically coupled to the outer conductor of the cable.

The outer body 44 includes a flange 48 that extends radially inwardly from its inner surface. The rear edge of the flange 48 abuts the larger "step" of the spacer 50. At its forward end, the outer body 44 includes a shoulder 45, and further includes a contact surface 47 that is radially outward of the shoulder 45. The outer body 44 also includes threads 46 on its outer surface.

A gap 54 is present between the narrower "step" of the spacer 50 and the inner surface of the outer body 44. The spacer 50 also has a beveled forward edge 52 on the narrower "step.".

Figure 5:
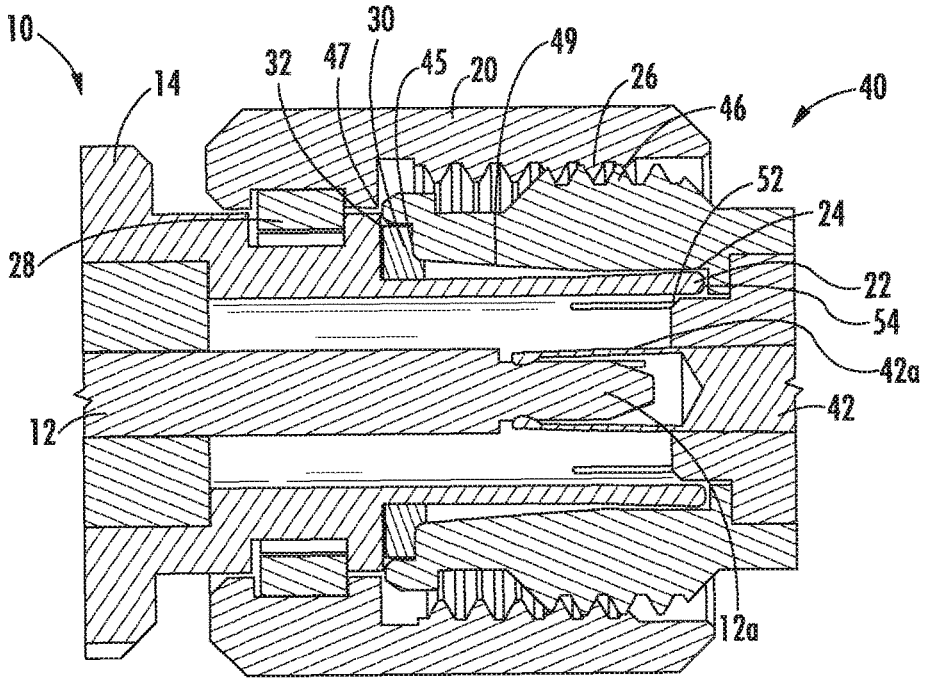
FIG. 5 is a section view of the male connector of FIG. 1 mated with the female connector of FIG. 3.

Referring now to FIG. 5, mating of the male connector 10 and the female connector 40 is achieved by inserting the tip 12*a* of the inner contact 12 of the male connector 10 into the spring fingers 42*a* of the inner contact 42 of the female connector 40. The spring fingers 42*a* exert radial pressure on the tip 12*a*. Also, the spring fingers 22 of the outer body 14 of the male connector 10 are inserted into the gap 54 between the spacer 50 and the inner surface of the outer body 44 of the female connector 40. Both the inclined inner surface 49 of the outer body 44 and the beveled forward edge 52 of the spacer 50 facilitate movement of the spring fingers 22 into the gap 54. The outer diameter of the spring fingers 42*a* is typically more than the inner diameter of the outer body 44, with the result that the outer surfaces 24 of the spring fingers 22 are in contact with and exert radial pressure on the inner surface of the outer body 44. This contact establishes the "electrical reference plane" identified in the 4.3/10 standard (see FIG. 7). In some instances, the spacer 50 will remain in contact with the inner surfaces of the spring fingers 22 and provide radial support thereto. Because the spring fingers 22 are forced to apply relatively high radial pressure to the inner surface of the outer body 44, it is expected that the PIM performance of the mated connectors 10, 40 should be very good.

The mated connectors 10, 40 are coupled by rotation of the coupling nut 20 onto the outer body 44, with the threads 26 of the coupling nut 20 intermeshing with the threads 46 of the outer body 44. Notably, mating of the male and female connectors 10, 40 is complete when the contact surface 47 of the outer body 44 of the female connector 40 makes axial contact with the shoulder 32 of the outer body 14 of the male connector 10. This contact prevents further relative axial movement between the connectors 10, 40 and establishes the "mechanical reference plane" identified in the 4.3/10 standard (see FIG. 6). Thus, the electrical and mechanical reference planes are separated as required by the 4.3/10 standard. As can be seen in FIG. 7, the ends of the spring fingers 22 are not in contact with the flange 48 of the outer body 44.

Figure 6:
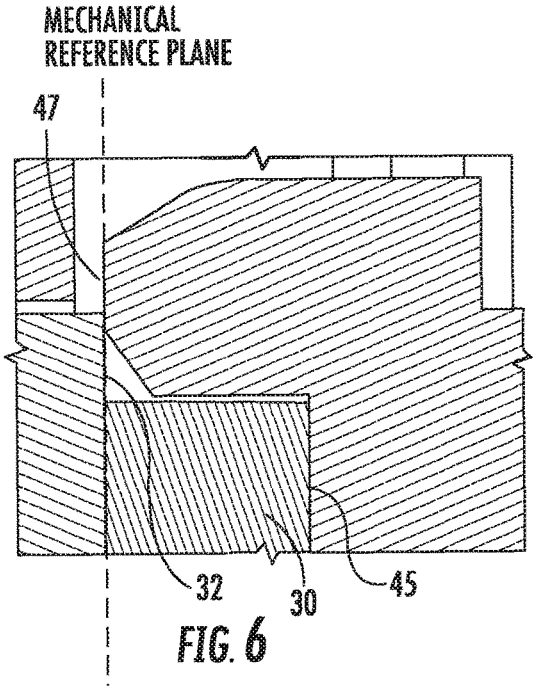
FIG. 6 is an enlarged partial section view of the mechanical contact plane of the mated connectors of FIG. 5.
Figure 7:
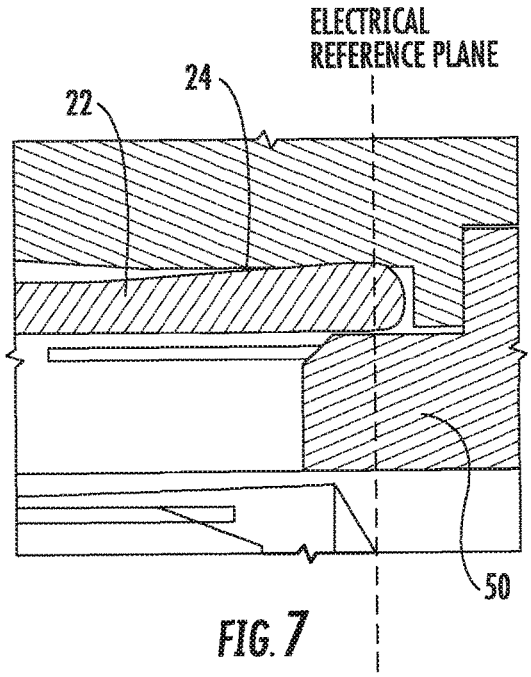
FIG. 7 is an enlarged partial section view of the electrical contact plane of the mated connectors of FIG. 5.

As is also seen in FIG. 6, the interaction between the shoulder 45 and the gasket 30 can provide a watertight seal for mated connectors 10, 40.

The outer bodies 14, 44 are formed of conductive materials. In some embodiments, the outer body 14 may be formed of brass (e.g., 36000 brass) for cost reasons; the use of a single piece outer body 14 with integrated spring fingers 22 can enable the use of such a low cost material.

The dielectric spacers 16, 50 are formed of a dielectric material, typically a polymeric material. Because the spacer 50 will often contact the spring fingers 22 of the outer body 14, the spacer 50 may be formed of a polymeric material having a relatively high hardness, such as PTFE.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial male connector, comprising:

an inner contact configured to mate with spring fingers of an inner contact of a mating coaxial female connector;

a monolithic outer body having a plurality of spring fingers configured to mate with an inner surface of an outer body and engage a dielectric spacer of the mating female connector, the monolithic outer body including a shoulder that is located radially outward of the spring fingers that is configured to provide a contact surface for the outer body of the mating female connector;

a dielectric spacer disposed between the inner contact and the outer body of the male connector such that the outer body is coaxial with the inner contact; and a coupling nut that at least partially overlies the outer body.

2. The coaxial male connector defined in claim 1, wherein the spring fingers of the male connector have opposed fixed and free ends, and wherein the free ends splay radially outward.

3. The coaxial male connector defined in claim 1, wherein the spring fingers of the male connector have an increased thickness adjacent the free ends relative to the fixed ends.

4. The coaxial male connector defined in claim 1, wherein the outer body of the male connector includes a recess, the coupling nut includes a recess, and a snap ring resides in the recesses of the outer body and the coupling nut.

5. The coaxial male connector defined in claim 1, further comprising a gasket abutting the shoulder of the outer body.

6. The coaxial male connector defined in claim 1, wherein the coupling nut includes internal threads.

7. A coaxial female connector, comprising:

an inner contact having a plurality of spring fingers configured to mate with spring fingers of an inner contact of a coaxial male connector;

an outer body having an inner surface and a contact surface at one end, the contact surface being configured to contact a shoulder of an outer body of a mating coaxial male connector; and a dielectric spacer disposed between the inner contact and the outer body such that the outer body is coaxial with the inner contact, the spacer being configured so that a gap is present between an outer surface of the spacer and the inner surface of the outer body, the gap being configured to receive spring fingers of the outer body of the mating male connector such that the spring fingers of the male connector engage the outer surface of the spacer and mate with the inner surface of the outer body.

8. The coaxial female connector defined in claim 7, wherein the outer body has a radially inward flange that defines a closed end of the gap.

9. The coaxial female connector defined in claim 7, wherein the outer body has an inclined inner surface.

10. The coaxial female connector defined in claim 7, wherein the outer body includes a shoulder radially inward of the contact surface.

11. The coaxial female connector defined in claim 7, wherein the spacer has a beveled edge adjacent the gap.

12. The coaxial female connector defined in claim 7, wherein the outer body includes external threads.

13. An assembly comprising a coaxial male connector and a coaxial female connector, wherein the coaxial male connector comprises:

an inner contact;

an outer body having a plurality of spring fingers and a shoulder that is located radially outward of the spring fingers;

a dielectric spacer disposed between the inner contact and the outer body such that the outer body is coaxial with the inner contact; and a coupling nut that at least partially overlies the outer body;

and wherein the female coaxial connector comprises:

an inner contact having a plurality of spring fingers mated with the inner contact of the male connector;

an outer body having an inner surface and a contact surface at one end, the contact surface axially contacting the shoulder of the outer body of the male connector; and a dielectric spacer disposed between the inner contact and the outer body such that the outer body is coaxial with the inner contact, the spacer being configured so that a gap is present between an outer surface of the spacer and the inner surface of the outer body, wherein the spring fingers of the outer body of the male connector engage the outer surface of the dielectric spacer and mate with the inner surface of the outer body of the female connector applying radial pressure to the inner surface of the outer body of the female connector.

14. The assembly defined in claim 13, wherein the spring fingers of the outer body of the male connector have opposed fixed and free ends, and wherein the free ends splay radially outward.

15. The assembly defined in claim 13, wherein the spring fingers of the outer body of the male connector have an increased thickness adjacent the free ends relative to the fixed ends.

16. The assembly defined in claim 13, further comprising a gasket abutting the shoulder of the outer body of the male connector, and wherein the outer body of the female connector includes a shoulder radially inward of the contact surface that engages the gasket.

17. The assembly defined in claim 13, wherein the coupling nut includes internal threads, and the outer body of the female connector includes external threads that intermesh with the internal threads of the coupling nut.

18. The assembly defined in claim 13, wherein the outer body of the female connector has a radially inward flange that defines a closed end of the gap.

19. The assembly defined in claim 13, wherein the outer body of the female connector has an inclined inner surface.

20. The assembly defined in claim 13, wherein the spring fingers of the outer body of the male connector contact the spacer of the female connector.

* * * * *